US010502071B2

(12) United States Patent
Davis et al.

(10) Patent No.: US 10,502,071 B2
(45) Date of Patent: Dec. 10, 2019

(54) CONTROLLING COOLING FLOW IN A COOLED TURBINE VANE OR BLADE USING AN IMPINGEMENT TUBE

(71) Applicant: Siemens Aktiengesellschaft, Munich (DE)

(72) Inventors: Anthony Davis, Bassingham (GB); Jonathan Mugglestone, Brinsley (GB)

(73) Assignee: Siemens Aktiengesellschaft, Munich (DE)

( * ) Notice: Subject to any disclaimer, the term of this patent is extended or adjusted under 35 U.S.C. 154(b) by 437 days.

(21) Appl. No.: 15/302,071

(22) PCT Filed: Mar. 10, 2015

(86) PCT No.: PCT/EP2015/054912
§ 371 (c)(1),
(2) Date: Oct. 5, 2016

(87) PCT Pub. No.: WO2015/158468
PCT Pub. Date: Oct. 22, 2015

(65) Prior Publication Data

US 2017/0122112 A1 May 4, 2017

(30) Foreign Application Priority Data

Apr. 16, 2014 (EP) ..... 14164879

(51) Int. Cl.
*F01D 5/18* (2006.01)
*F01D 5/14* (2006.01)

(52) U.S. Cl.
CPC ..... *F01D 5/189* (2013.01); *F01D 5/147* (2013.01); *F01D 5/18* (2013.01); *F05D 2260/201* (2013.01)

(58) Field of Classification Search
CPC . F01D 5/147; F01D 5/18; F01D 5/189; F05D 2220/32; F05D 2260/201
See application file for complete search history.

(56) References Cited

U.S. PATENT DOCUMENTS 3,038,698 A * 6/1962 Troyer ..... F01D 5/148 415/12
3,574,481 A * 4/1971 Pyne, Jr. ..... F01D 5/189 416/90 R (Continued)

FOREIGN PATENT DOCUMENTS

CN 1715618 A 1/2006
EP 2573325 A 3/2013

(Continued)

OTHER PUBLICATIONS

CN Office Action dated Jun. 1, 2017, for CN patent application No. 201580020033.5.

(Continued)

*Primary Examiner* — Nathaniel E Wiehe
*Assistant Examiner* — Andrew J Marien
(74) *Attorney, Agent, or Firm* — Beusse Wolter Sanks & Maire

(57) ABSTRACT

An airfoil for a gas turbine having an outer shell with an inner volume and an inner shell arranged within the inner volume of the outer shell, wherein the inner shell has an aerodynamic profile having an inner nose section and an inner tail section. A first cooling channel and a second cooling channel merge into a common cooling channel at an inner tail section. A first tail fin is arranged between the first cooling channel and the common cooling channel such that a first mass flow rate of the cooling fluid flowing through the first cooling channel is controllable. A second tail fin is arranged between the second cooling channel and the com- (Continued)

mon cooling channel such that a second mass flow rate of the cooling fluid flowing through the second cooling channel is controllable.

16 Claims, 4 Drawing Sheets

(56) References Cited

U.S. PATENT DOCUMENTS

| | | | | |
|---|---|---|---|---|
| 4,437,810 | A * | 3/1984 | Pearce | F01D 5/189 415/115 |
| 4,473,336 | A * | 9/1984 | Coney | B23P 15/04 416/223 A |
| 4,583,914 | A * | 4/1986 | Craig | F01D 5/147 416/204 A |
| 4,859,141 | A | 8/1989 | Maisch et al. | |
| 5,511,937 | A * | 4/1996 | Papageorgiou | F01D 5/189 415/115 |
| 6,514,046 | B1 * | 2/2003 | Morrison | F01D 5/187 416/229 A |
| 7,824,150 | B1 * | 11/2010 | Kimmel | F01D 5/147 415/115 |
| 8,277,193 | B1 * | 10/2012 | Brostmeyer | F01D 5/147 29/889.721 |
| 2006/0120869 | A1 * | 6/2006 | Wilson | F01D 5/147 416/97 R |
| 2011/0007672 | A1 | 1/2011 | Park et al. | |
| 2012/0219402 | A1 * | 8/2012 | Harding | F01D 5/189 415/115 |
| 2014/0234088 | A1 * | 8/2014 | Brandl | F01D 5/081 415/177 |

FOREIGN PATENT DOCUMENTS

| | | | |
|---|---|---|---|
| EP | 2573325 | A1 | 3/2013 |
| EP | 2628901 | A1 | 8/2013 |
| FR | 2943380 | A1 | 9/2010 |
| RU | 2111416 | C1 | 5/1998 |
| RU | 2503131 | C2 | 12/2013 |
| UA | 98097 | C2 | 4/2012 |

OTHER PUBLICATIONS

RU Office Action dated Jan. 18, 2018, for RU patent application No. 2016140435.

EP Search Report dated Jul. 15, 2014, for EP application No. 14164879.0.

International Search Report dated May 29, 2015, for PCT application No. PCT/EP2015/054912.

* cited by examiner

CONTROLLING COOLING FLOW IN A COOLED TURBINE VANE OR BLADE USING AN IMPINGEMENT TUBE

CROSS REFERENCE TO RELATED APPLICATIONS

This application is the US National Stage of International Application No. PCT/EP2015/054912 filed Mar. 10, 2015, and claims the benefit thereof. The International Application claims the benefit of European Application No. EP14164879 filed Apr. 16, 2014. All of the applications are incorporated by reference herein in their entirety.

FIELD OF INVENTION

The present invention relates to an airfoil for a gas turbine. Furthermore, the present invention relates to a method of manufacturing an airfoil for a gas turbine.

ART BACKGROUND OF INVENTION

A gas turbine comprises a compressor stage and a turbine stage. In each stage, respective airfoils, i.e. rotatable blades and stationary vanes, are arranged, which are exposed to a working fluid which streams through the gas turbine. The turbine stages are arranged downstream of a burner of the gas turbine, such that the vanes and blades are exposed to a hot working fluid. Hence, the vanes and blades have to be cooled in order to extend the lifetime.

It is known to install an impingement tube inside a respective airfoil, wherein cooling fluid streams through the impingement tube against an inner surface of the airfoil.

When cooling fluid streams against an inner surface of the airfoil by using an impingement tube, the cooling fluid will take further the path of least resistance along cooling ducts formed between the inner surface of the airfoil and the outer surface of the impingement tube. Hence, if cooling fluid is injected in a nose region of the impingement tube, more mass flow of cooling fluid is flowing through a cooling duct along one airfoil surface than through another cooling duct along an opposite airfoil surface.

FIG. 6 shows a conventional airfoil for a gas turbine which comprises a conventional outer shell 601 and a conventional inner shell 610. A conventional cooling channel 602 is formed along the suction side and hence the longer low pressure side between the conventional outer shell 601 and the conventional inner shell 610. Respectively, a conventional further cooling channel 603 is formed along the shorter high pressure side between the conventional outer shell 601 and the conventional inner shell 610. The conventional inner shell 610 comprises a conventional fluid outlet at the nose section of the conventional inner shell 610 such that cooling fluid is ejected from the conventional inner shell 610 into the conventional cooling channels 602 and the conventional further cooling channels 603, respectively.

In particular, the impingement tube (conventional inner shell 610) and the airfoil (conventional outer shell 601), respectively, comprise the longer low pressure side and a shorter (with respect to the longer lower pressure side) high pressure side. Hence, more mass flow of cooling fluid on the shorter high pressure side flows through the conventional further cooling channels 603 than through the conventional cooling channels 602 along the longer low pressure (suction) side. This results in unequal cooling efficiency and leads to hot metal temperatures in some regions and cool metal temperatures in others. The cooling fluid is drained of through a conventional outer fluid outlet 605 which is formed at a tail section of the conventional outer shell 601.

FIG. 7 shows a conventional airfoil similar to the conventional airfoil shown in FIG. 5. FIG. 6 shows a conventional airfoil which comprises a separating element 701 and a further conventional fluid outlet 702 for adjusting the mass flow of cooling fluid through the respective conventional cooling channels 602, 603. The conventional fluid outlet 604 is formed in the conventional inner shell 610 such that the cooling fluid streams directly into the further conventional cooling channel 603. Additionally, the further conventional fluid outlet 702 is formed into the conventional inner shell 610 for streaming the cooling fluid directly into the conventional fuel channel 602. The conventional fuel channel 602 and the conventional further cooling channels 603 are separated by the separating element 701 which is installed at the nose section of the conventional inner shell 610 and the conventional outer shell 601. Hence, the respective conventional cooling channels 602, 603 are sealed from each other such that the injected cooling fluid into the respective cooling channels 602, 603 is exactly definable. However, complex control mechanisms and the plurality of conventional fluid outlets 604, 702 are necessary and the efficiency of the cooling compromised.

EP 2 628 901 A1 discloses a turbine blade with an impingement cooling. Flow channels are formed between an impingement tube and an outer wall of an airfoil. The impingement tube comprises a plurality of inlet holes for injecting a cooling fluid into the flow channels. Additionally, a blocking element is installed within a flow channel for directing the cooling fluid within the flow channel.

EP 2 573 325 A1 discloses a further impingement cooling for turbine blades or vanes. An impingement tube is installed within a hollow airfoil, wherein flow channels are formed between the impingement tube and the hollow airfoil. The impingement tube comprises a plurality of through holes.

Downstream of the impingement tube, a first impingement device is installed, wherein the cooling fluid flows through the flow channels and further against the first impingement device. The first impingement device comprises again a plurality of through holes through which the cooling fluid is flowable.

SUMMARY OF THE INVENTION

It may be an object to provide an airfoil for a gas turbine which comprises a simple cooling mechanism for cooling the airfoil.

This object is achieved by an airfoil for a gas turbine, by the gas turbine and by a method for manufacturing the airfoil according to the independent claims.

According to a first aspect of the present invention, an airfoil a gas turbine is presented. The airfoil comprises an (hollow) outer shell comprising an inner volume and an inner shell arranged within the inner volume of the outer shell. The inner shell comprises an aerodynamic profile having an inner nose section and an inner tail section, wherein a high pressure side of the inner shell is formed along a first surface section between inner nose section and the inner tail section and a low pressure side of the inner shell is formed along a second surface section which is located opposite to the first surface section between inner nose section and the inner tail section.

The inner shell is spaced apart from the outer shell such that (a) a first cooling channel is formed along the high pressure side between the inner nose section and the inner tail section and (b) a second cooling channel is formed along the low pressure side between the inner nose section and the inner tail section. The first cooling channel and the second cooling channel merge into a common cooling channel at the inner tail section.

The inner shell of the airfoil further may comprise a first tail fin arranged between the first cooling channel and the common cooling channel such that a first mass flow rate of the cooling fluid flowing through the first cooling channel is controllable. Furthermore, the inner shell of the airfoil may further comprises a second tail fin arranged between the second cooling channel and the common cooling channel such that a second mass flow rate of the cooling fluid flowing through the second cooling channel is controllable.

According to a further aspect of the present invention, a gas turbine is presented, which comprises the above described airfoil. The airfoil forms a stationary vane or a rotatable blade of the gas turbine.

According to a further aspect of the present invention, a method of manufacturing the above described airfoil for a gas turbine is presented.

The airfoil according to the present invention may be arranged within a compressor stage or a turbine stage of the gas turbine. The airfoil may be a rotatable blade or a stationary vane, which are exposed to a working fluid which streams through the gas turbine. In particular, the turbine stages are arranged downstream of a burner of the gas turbine, such that the airfoil is exposed to a hot working fluid.

And the outer shell forms the outer skin of the airfoil. The outer shell comprises a hollow shape and hence comprises the inner volume.

The inner shell is arranged within the inner volume of the outer shell. The outer shell and the inner shell may form respective aerodynamic profiles.

An aerodynamic profile according to the present invention describes a profile which is adapted for generating lift when an fluid flows along the respective surfaces of the aerodynamic profile. The aerodynamic profile comprises a nose section. The nose section forms the section of the profile where the fluid streams for the first time against the aerodynamic profile. Accordingly, the aerodynamic profile comprises a tail section which is located downstream of the nose section. The air streaming along the aerodynamic profile leaves the profile from the tail section.

A first surface section and a second surface section, which is located opposite with respect to the first surface section, extend from the nose section to the tail section. The first surface section and the second surface section comprise respective curvature shapes, wherein the curvature of the first surface section differs from the curvature of the second surface section. Hence, the first surface section, which comprises a smaller curvature with respect to the second surface section, is shorter (along a direction between the nose section and the tail section) with respect to the second surface section. Accordingly, the second surface section is longer (along a direction between the nose section and the tail section) with respect to the first surface section.

Hence, the fluid streaming first against the nose section and further along the first surface section and the second surface section generate at the shorter first surface section a high pressure with respect to a fluid streaming along the long the second surface section, which generates a lower pressure with respect to the high pressure first surface section.

Hence, according to the present invention, the inner shell comprises the above described aerodynamic profile and comprises respectively an inner nose section and an inner tail section, wherein the high pressure side and the low pressure side are arranged between the inner nose section and the inner tail section. The high pressure side comprises a smaller curvature than the low pressure side.

The inner shell (i.e. an impingement tube) is made for example of a thin-walled sheet metal material. The inner shell may be formed hollow such that the cooling fluid may stream inside the inner shell. The inner shell comprises a smaller circumference than the outer shell, so that a distance and the gap, respectively, exists if the inner shell is arranged within the inner volume of the outer shell.

The first cooling channel defines the volume which is formed along the high pressure side between the inner nose section and the inner tail section and the second cooling channel defines the volume which is formed along the low pressure side between the inner nose section and the inner tail section.

Downstream of the inner tail section both, the first cooling channel and the second cooling channel, merge together and form a common volume which is named common cooling channel. The outer shell may comprise in a further exemplary embodiment a outer fluid outlet through which the fluid is bled of from the common cooling channel.

According to the present invention, at a section where the first cooling channel ends and the common cooling channel starts, the first tail fin is arranged. The first tail fin may be made of a thin metal sheet, for example. The first tail fin forms a passage with a predefined flow area such that the first mass flow rate of the cooling fluid passing the first tail fin is adjustable. In other words, the first tail fin reduces the flow area of the first cooling channel at the downstream end of the first cooling channel, which causes a defined pressure increase within the first cooling channel. Hence, the first mass flow rate streaming through the first cooling channel is controllable (i.e. reduced in a controlled manner) by the design of the first tail fin and by the adjustable pressure, respectively.

Accordingly, at a section where the second cooling channel ends and the common cooling channel starts, the second tail fin is arranged. The second tail fin may be made of a thin metal sheet, for example. The second tail fin forms a passage with a predefined flow area such that the second mass flow rate of the cooling fluid passing the second tail fin is adjustable. In other words, the second tail fin reduces the flow area of the second cooling channel at the downstream end of the second cooling channel, which causes a defined pressure increase within the second cooling channel. Hence, the second mass flow rate streaming through the second cooling channel is controllable (i.e. reduced in a controlled manner) by the design of the second tail fin and by the adjustable pressure, respectively.

Hence, by the approach of the present invention, customised first and second tail fins are formed and installed at the respective end sections of the first and second cooling channels. By the customised tail fins, the respective first and second mass flows of the cooling fluid may be adjusted to a desired ratio. Specifically, the customised first and second tail fins may adjust the first mass flow and the second mass flow in such a way that the first mass flow is equal (at least in one predefined operating state of the gas turbine) to the second mass flow such that the cooling fluid comprises the same cooling efficiency in the first cooling channel and in the second cooling channel. Hence, by comprising the second cooling efficiency of the cooling fluid along the high pressure side and long the low pressure side, thermal strain caused by sections with different temperatures is reduced and the lifetime of the inner shell and the outer shell, respectively, is increased.

According to a further exemplary embodiment, the first tail fin comprises a first fluid passage for controlling the first mass flow and/or the second tail fin comprises a second fluid passage for controlling the second mass flow.

The first fluid passage may be formed by a gap between the inner shell and the first tail fin or by a gap between the outer shell and the first tail fin. In the same way, the second fluid passage may be formed by a gap between the inner shell and the second tail fin or the outer shell and the second tail fin.

The first fluid passage may have a first size (e.g. a first flow area) which differs to a second size (e.g. a second flow area) of the second fluid passage. Hence, without any adjusted first and second tail fins, a higher mass flow of the cooling fluid would stream along the high pressure side than along the lower smaller low pressure side. Hence, this difference in the mass flow is equalised by the adjusted first and second tail fins comprising the respective fluid passages. For example, the first fluid passage may be smaller than the second fluid passage, such that the pressure at the high pressure side is increased and thus more cooling fluid flows through the second cooling channel along the low pressure side such that the first and second cooling fluid mass flows are equal.

According to a further exemplary embodiment of the present invention, the first tail fin comprises at least one first through hole for forming the first fluid passage and/or the second tail fin comprises at least one second through hole for forming the second fluid passage.

Accordingly, a first size of the first through hole differs to a second size of the second through hole for adjusting the first mass flow with respect to the second mass flow.

Furthermore, the first tail fin may comprise a first pattern of the plurality of first passages and first through holes, respectively, and the second tail fin may comprise a second pattern of a plurality of second passages and second through holes, respectively.

According to a further exemplary embodiment, the high pressure side and the low pressure side are connected within the inner tail section and form an inner tail edge extending along a span width of the inner shell.

According to a further exemplary embodiment, the first tail fin and the second tail fin are coupled to the inner tail edge and extend from the inner tail edge to the outer shell. Hence, the first passage may be formed between an edge of the first tail fin and the outer shell and the second passage may be formed between an edge of the second tail fins and the outer shell.

According to a further exemplary embodiment, the first tail fin is elastically deformable such that a gap between the first tail fin and the outer shell is adjustable by elastically deforming the first tail fin. Accordingly, the second tail fin may be also elastically deformable such that a further gap between the second tail fin and the outer shell is adjustable by elastically deforming the second tail fin.

The first tail fin is deformable for example due to a predefined pressure of the cooling fluid flowing through the first cooling channel. Hence, if the pressure increases, the first tail fin may be deformed more such that the gap increases and hence the flow rate and the first mass flow increases as well. Hence, the respective first and second tail fins may flexibly adjust the first and second mass flows of the cooling fluid through the respective first and second cooling channels dependent on the pressure of the cooling fluid and hence dependent on the operating state of the gas turbine.

According to a further exemplary embodiment, the airfoil further comprises a retaining element arranged within the common cooling channel downstream of the first tail fin. The retaining element is arranged such that the retaining element prevents a further deformation if a predetermined maximum deformation of the first tail fin is reached.

According to a further exemplary embodiment, the outer shell comprises an aerodynamic profile and hence an outer nose section. The inner shell is arranged within the inner volume such that between the inner nose section and the outer nose are spaced apart from each other such that a nose volume is generated which is connected to the first cooling channel and the second cooling channel. The inner nose section comprises a fluid outlet (i.e. a jet) such that a cooling fluid is ejected from the inside of the inner shell into the nose volume.

According to a further exemplary embodiment, the high pressure side and/or the low pressure side are free of further fluid outlets.

This is possible by the above described airfoil according to the present invention, because the mass flow through the respective cooling channels may be controlled by the respective tail fin such that only one fluid outlet at the nose section of the inner shell is sufficient for providing an adequate mass flow and hence a desired cooling effect.

It has to be noted that embodiments of the invention have been described with reference to different subject matters. In particular, some embodiments have been described with reference to method type claims whereas other embodiments have been described with reference to apparatus type claims. However, a person skilled in the art will gather from the above and the following description that, unless other notified, in addition to any combination of features belonging to one type of subject matter also any combination between features relating to different subject matters, in particular between features of the method type claims and features of the apparatus type claims is considered as to be disclosed with this document.

BRIEF DESCRIPTION OF THE DRAWINGS

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

DETAILED DESCRIPTION

Figure 1:
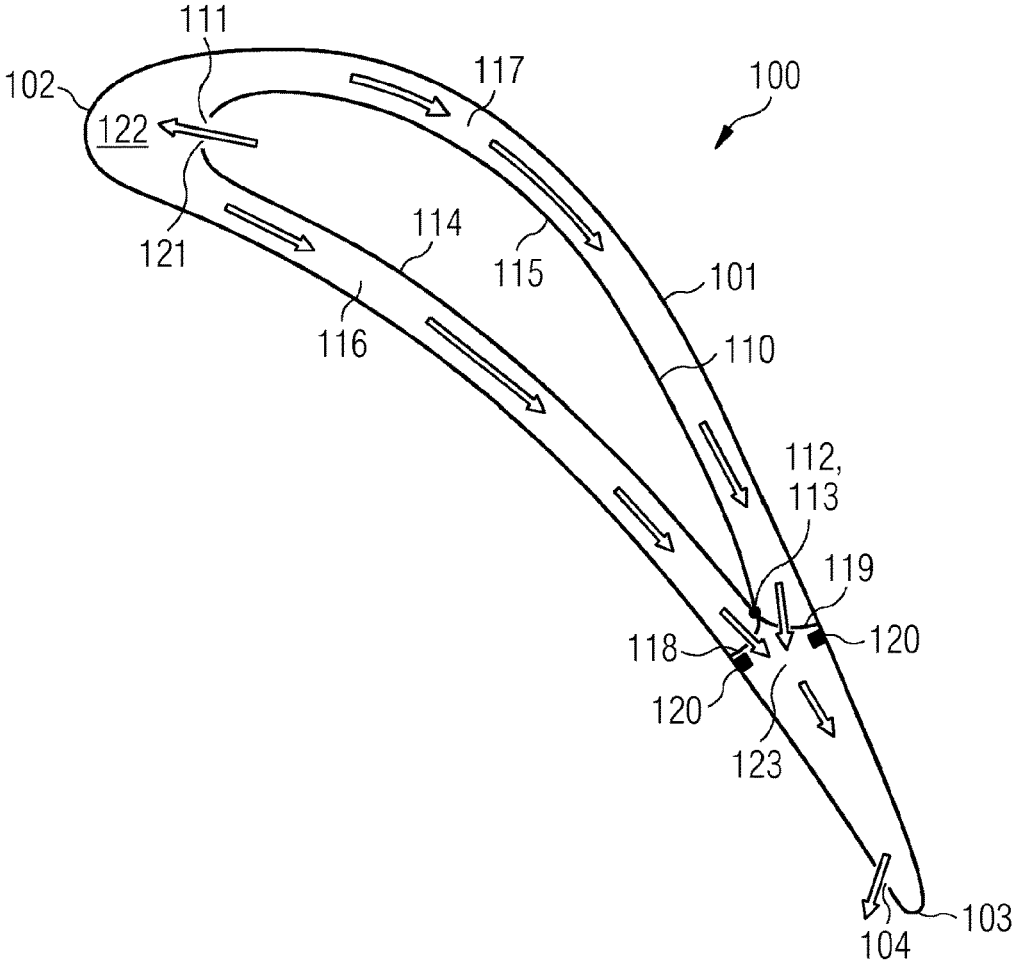
FIG. 1 shows a sectional view of an airfoil according to an exemplary embodiment of the present invention.

The illustration in the drawings is in schematic form. It is noted that in different figures, similar or identical elements are provided with the same reference signs.

FIG. 1 shows a sectional view of an airfoil 100 according to an exemplary embodiment of the present invention. The airfoil 100 comprises an (hollow) outer shell 101 comprising an inner volume and an inner shell 110 arranged within the inner volume of the outer shell 101. The inner shell 110 comprises an aerodynamic profile having an inner nose section 111 and an inner tail section 112, wherein a high pressure side 114 of the inner shell 110 is formed along a first surface section between inner nose section 111 and the inner tail section 111 and a low pressure side of the inner shell 110 is formed along a second surface section which is located opposite to the first surface section between inner nose 111 section and the inner tail section 112.

The inner shell 110 is spaced apart from the outer shell 101 such that (a) a first cooling channel 116 is formed along the high pressure side 114 between the inner nose section 111 and the inner tail section 112 and (b) a second cooling channel 117 is formed along the low pressure side 115 between the inner nose section 111 and the inner tail section 112. The first cooling channel 116 and the second cooling channel 117 merge into a common cooling channel 123 at the inner tail section 112.

The airfoil 100 further comprises a first tail fin 118 arranged between the first cooling channel 116 and the common cooling channel 123 such that a first mass flow rate of the cooling fluid flowing through the first cooling channel 116 is controllable.

Furthermore, the airfoil 100 further comprises a second tail fin 119 arranged between the second cooling channel 117 and the common cooling channel 123 such that a second mass flow rate of the cooling fluid flowing through the second cooling channel 117 is controllable.

The outer shell 101 forms the outer skin of the airfoil 100. The outer shell 101 is exposed to the hot working fluid flowing through the gas turbine. The outer shell 101 comprises a hollow shape and hence comprises the inner volume.

The inner shell 110 is arranged within the inner volume of the outer shell 101. The outer shell 101 and the inner shell 110 may form respective aerodynamic profiles.

The inner shell 110 is formed hollow such that the cooling fluid may stream inside the inner shell 110. The inner shell 110 comprises a smaller circumference than the outer shell 101, so that a distance and the gap, respectively, exists.

The first cooling channel 116 defines the volume which is formed along the high pressure side 114 between the inner nose section 111 and the inner tail section 112 and the second cooling channel 117 defines the volume which is formed along the low pressure side 115 between the inner nose section 111 and the inner tail section 112.

Downstream of the inner tail section 112 both, the first cooling channel 116 and the second cooling channel 117, merge together and form a common volume which is named common cooling channel 123. The outer shell 101 comprises a outer fluid outlet 104 through which the fluid is bled of from the common cooling channel 123.

At a section where the first cooling channel ends and the common cooling channel 123 starts, the inner shell 110 forms an inner tail edge 113 where the first tail fin 118 is arranged. The first tail fin 118 forms a passage with a predefined flow area such that the first mass flow rate of the cooling fluid passing the first tail fin 118 is adjustable. In other words, the first tail fin 118 reduces the flow area of the first cooling channel 116 at the downstream end of the first cooling channel 116, which causes a defined pressure increase within the first cooling channel 116. Hence, the first mass flow rate streaming through the first cooling channel 116 is controllable (i.e. reduced in a controlled manner) by the design of the first tail fin 118 and by the adjustable pressure, respectively.

Accordingly, at a section where the second cooling channel 117 ends and the common cooling channel 123 starts, the second tail fin 119 is arranged. The second tail fin 119 forms a passage with a predefined flow area such that the second mass flow rate of the cooling fluid passing the second tail fin 119 is adjustable. In other words, the second tail fin 119 reduces the flow area of the second cooling channel 117 at the downstream end of the second cooling channel 117, which causes a defined pressure increase within the second cooling channel 117. Hence, the second mass flow rate streaming through the second cooling channel 117 is controllable (i.e. reduced in a controlled manner) by the design of the second tail fin 119 and by the adjustable pressure, respectively.

The first fluid passage may have a first size (e.g. a first flow area) which differs to a second size (e.g. a second flow area) of the second fluid passage. Hence, without any adjusted first and second tail fins 118, 119, a higher mass flow of the cooling fluid would stream along the high pressure side 114 than along the lower smaller low pressure side 115. Hence, this difference in the mass flow is equalised by the adjusted first and second tail fins 118, 119 comprising the respective fluid passages. For example, the first fluid passage may be smaller than the second fluid passage, such that the pressure at the high pressure side 114 is increased and thus more cooling fluid flows through the second cooling channel 117 along the low pressure side 115 such that the first and second cooling fluid mass flows are equal.

The first tail fin 118 (and/or the second tail fin 119) is elastically deformable such that a gap between the first tail fin 118 and the outer shell 101 is adjustable by elastically deforming the first tail fin 118. Accordingly, the second tail fin 119 may be also elastically deformable such that a further gap between the second tail fin 119 and the outer shell 101 is adjustable by elastically deforming the second tail fin 119.

The first tail fin 118 and the second tail fin 119 are deformable in predetermined manner (for example by predefining the material and/or the thickness of the respective tail fins 118, 119) for example due to a predefined pressure of the cooling fluid flowing through the respective first and second cooling channel 116, 117. Hence, if the pressure increases, the first tail fin 118 may be deformed more such that the gap increases and hence the flow rate and the first mass flow increases as well. Hence, the respective first and second tail fins 118, 119 may flexibly adjust the first and second mass flows of the cooling fluid through the respective first and second cooling channels 116, 117 dependent on the pressure of the cooling fluid and hence dependent on the operating state of the gas turbine.

The airfoil 100 further comprises a retaining element 120 arranged within the common cooling channel 123 downstream of the first tail fin 118. The retaining element 120 is arranged such that the retaining element 123 prevents a further deformation of the first tail fin 118 if a predetermined maximum deformation of the first tail fin 118 is reached. Accordingly a further retaining element 123 may be arranged for preventing a further deformation of the second tail fin 119.

The outer shell 110 comprises an aerodynamic profile and hence an outer nose section 102. The inner shell 110 is arranged within the inner volume such that between the inner nose section 111 and the outer nose 102 are spaced apart from each other such that a nose volume 122 is generated which is connected to the first cooling channel 116 and the second cooling channel 117. The inner nose section 111 comprises the fluid outlet (i.e. jet) 121 such that the cooling fluid is ejected from the inside of the inner shell 110 into the nose volume 122. The high pressure side 114 and/or the low pressure side 115 are free of further fluid outlets.

Figure 2:
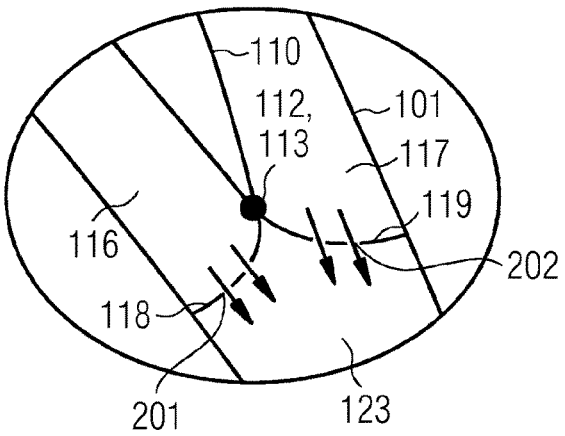
FIG. 2 shows an enlarged view of a section of the airfoil as shown in FIG. 1.

FIG. 2 shows an enlarged view of a section of the airfoil 100 as shown in FIG. 1. The first tail fin 118 comprises at least one first through hole 201 for forming the first fluid passage and/or the second tail fin 119 comprises at least one second through hole 202 for forming the second fluid passage.

Accordingly, a first size of the first through hole 201 may differ to a second size of the second through hole 202 for adjusting the first mass flow with respect to the second mass flow.

Figure 3:
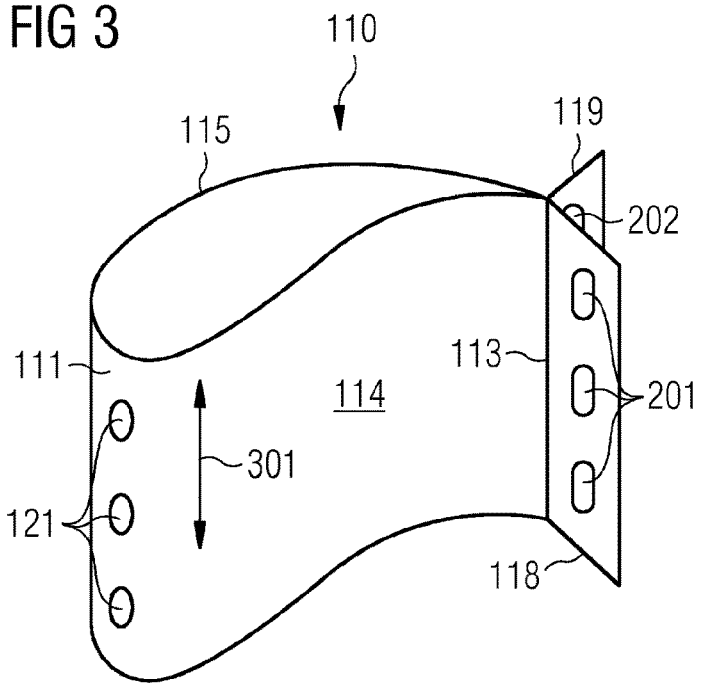
FIG. 3 shows a schematic view of an inner shell according to an exemplary embodiment of the present invention, wherein through holes are formed in the respective tail fin.

FIG. 3 shows a perspective view of the inner shell 110, wherein through holes 201, 201 are formed in the respective tail fins 118, 119.

The first tail fin 118 comprises a first pattern of the plurality of first passages and first through holes 201, respectively, and the second tail fin 119 comprises a second pattern of a plurality of second passages and second through holes 202, respectively.

The high pressure side 114 and the low pressure side 115 are connected within the inner tail section 112 and form an inner tail edge 113 extending along a span width 301 of the inner shell 110. The first tail fin 118 and the second tail fin 119 are coupled to the inner tail edge 113 and extend from the inner tail edge 113 to the outer shell 101.

Figure 4:
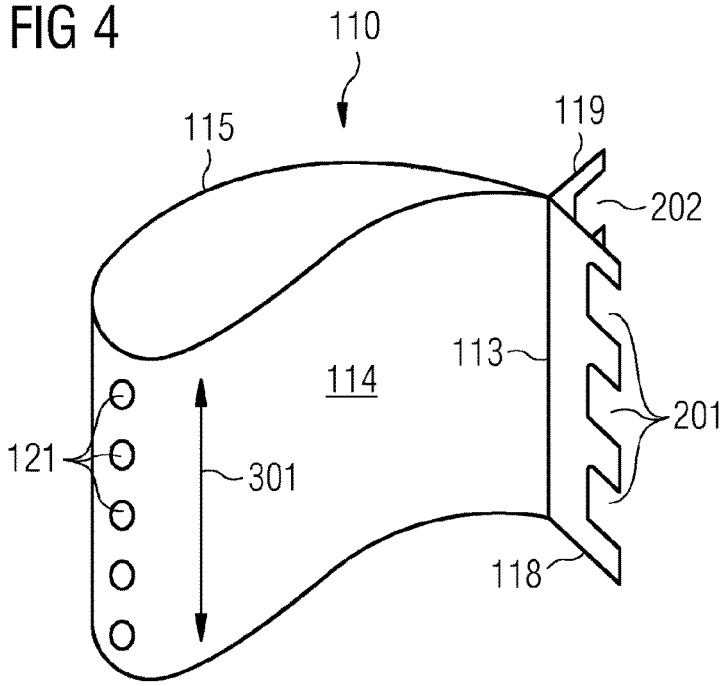
FIG. 4 shows a schematic view of an inner shell according to an exemplary embodiment of the present invention, wherein cutouts are formed in the respective tail fin.

FIG. 4 shows a perspective view of the inner shell 110, wherein cutouts and hence through holes 201, 202 are formed in the respective tail fins 118, 119.

Figure 5:
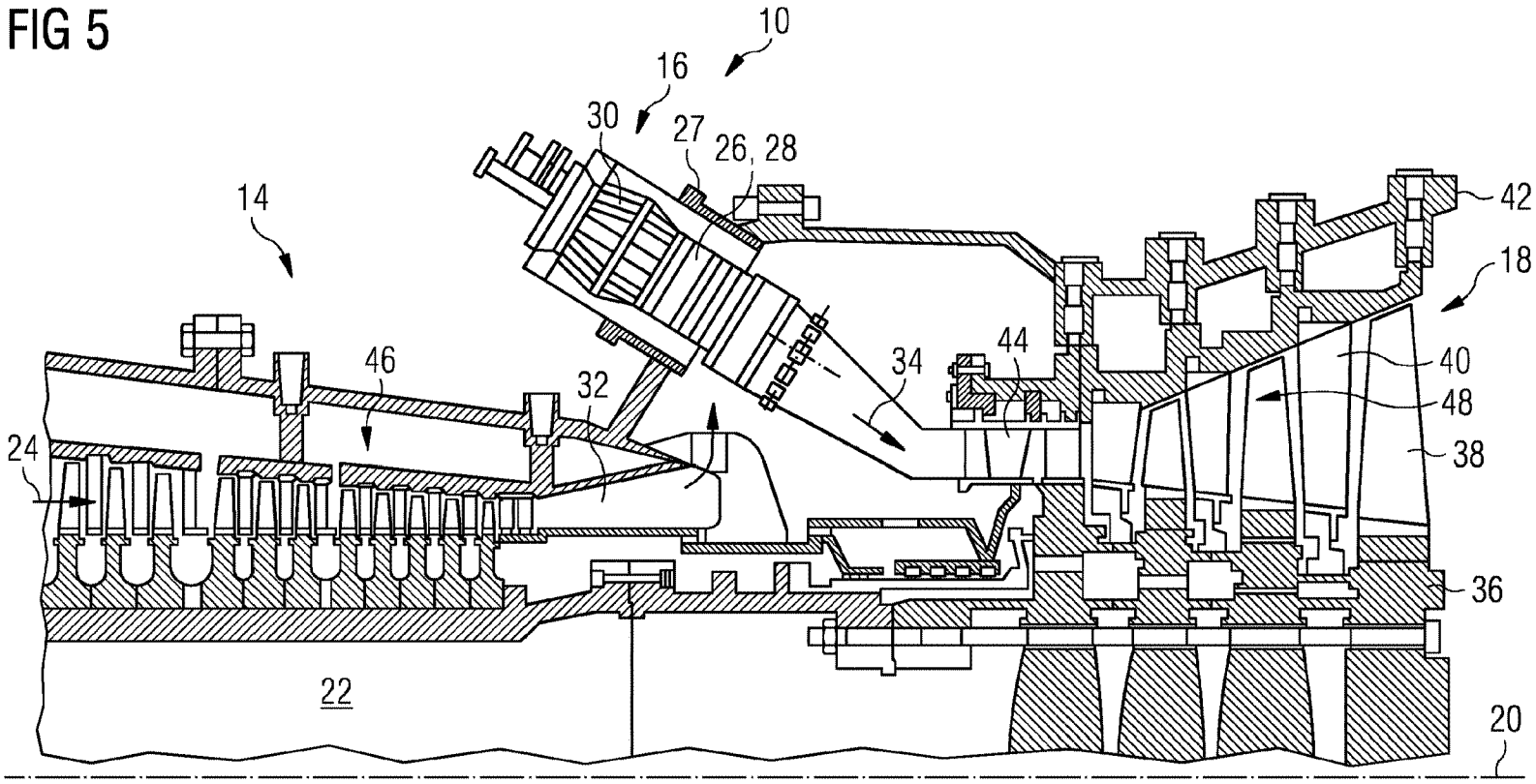
FIG. 5 shows a schematic view of a gas turbines which comprises an airfoil according to an exemplary embodiment of the present invention.
Figure 6:
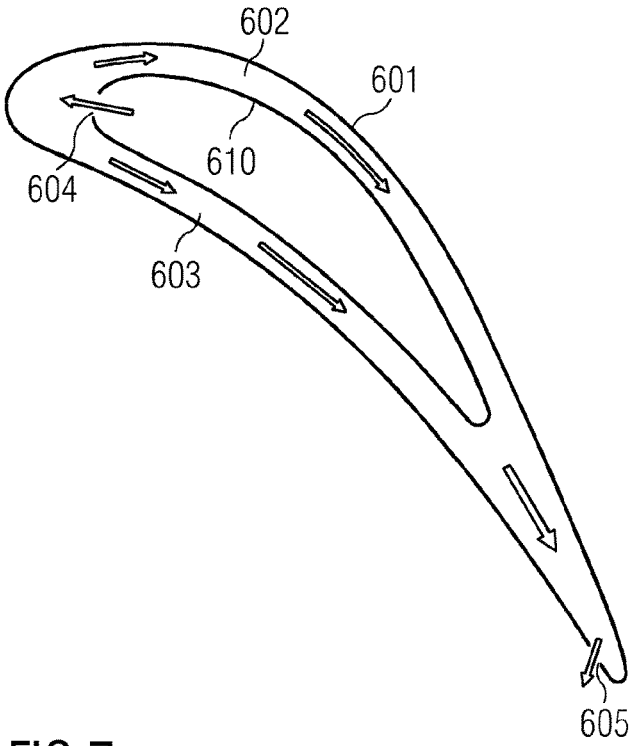
FIG 6 PRIOR ART
FIG. 6 and FIG. 7 show conventional airfoils for gas turbines.
Figure 7:
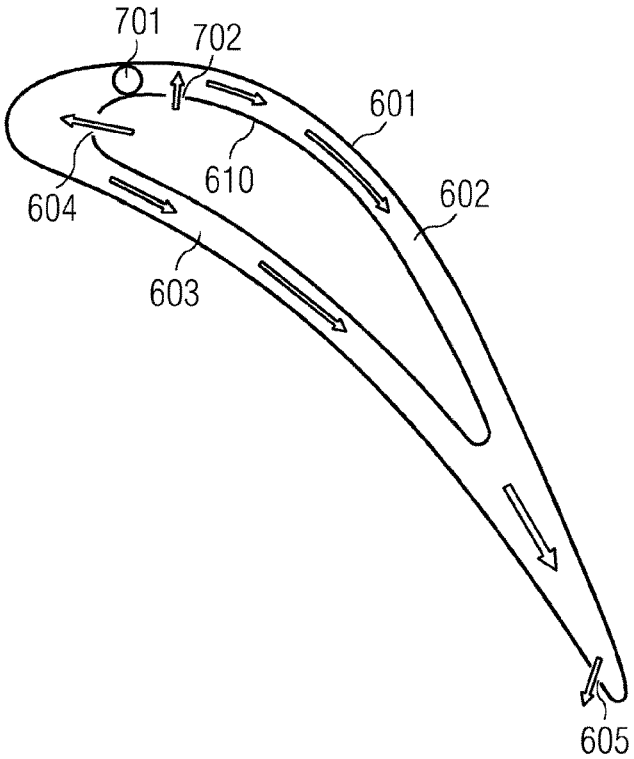
FIG 7 PRIOR ART

FIG. 5 shows a schematic view of a gas turbines which comprises an airfoil 100 according to an exemplary embodiment of the present invention.

FIG. 5 shows an example of a gas turbine engine 10 in a sectional view. The gas turbine engine 10 comprises, in flow series, an inlet, a compressor section 14, a combustor section 16 and a turbine section 18 which are generally arranged in flow series and generally in the direction of a longitudinal or rotational axis 20. The gas turbine engine 10 further comprises a shaft 22 which is rotatable about the rotational axis 20 and which extends longitudinally through the gas turbine engine 10. The shaft 22 drivingly connects the turbine section 18 to the compressor section 14.

In operation of the gas turbine engine 10, air 24, which is taken in through the air inlet is compressed by the compressor section 14 and delivered to the combustion section or burner section 16. The burner section 16 comprises a burner plenum 26, one or more combustion chambers 28 defined by a double wall can 27 and at least one burner 30 fixed to each combustion chamber 28. The combustion chambers 28 and the burners 30 are located inside the burner plenum 26. The compressed air passing through the compressor section 14 enters a diffuser 32 and is discharged from the diffuser 32 into the burner plenum 26 from where a portion of the air enters the burner 30 and is mixed with a gaseous or liquid fuel. The air/fuel mixture is then burned and the combustion gas 34 or working gas from the combustion is channelled via a transition duct 35 to the turbine section 18.

The turbine section 18 comprises a number of blade carrying discs 36 attached to the shaft 22. In the present example, two discs 36 each carry an annular array of turbine blades 38, which may be formed by the airfoil 100 as described above. However, the number of blade carrying discs could be different, i.e. only one disc or more than two discs. In addition, guiding vanes 40, which may be formed by the airfoil 100 as described above, which are fixed to a stator 42 of the gas turbine engine 10, are disposed between the turbine blades 38. Between the exit of the combustion chamber 28 and the leading turbine blades 38 inlet guiding vanes 44 are provided.

The combustion gas from the combustion chamber 28 enters the turbine section 18 and drives the turbine blades 38 which in turn rotates the shaft 22. The guiding vanes 40, 44 serve to optimise the angle of the combustion or working gas on to the turbine blades 38. The compressor section 14 comprises an axial series of guide vane stages 46 and rotor blade stages 48.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

REFERENCE SIGNS

10 gas turbine engine
14 compressor section
16 combustor section
18 turbine section
20 Rotational axis
22 shaft
24 air
26 burner plenum
27 can
28 combustion chamber
30 burner
32 diffuser
34 combustion gas
36 carrying discs
38 turbine blades
40 guiding vane
42 stator
44 inlet guiding vane
46 guide vane stages
48 rotor blade stages
100 airfoil
101 outer shell
102 outer nose section
103 outer tail section
104 outer fluid outlet
110 inner shell
111 inner nose section
112 inner tail section
113 inner tail edge
114 high pressure side, first surface section
115 low pressure side, second surface section
116 first cooling channel
117 second cooling channel
118 first tail fin
119 second tail fin
120 retaining element
121 fluid outlet
122 nose volume
123 common cooling channel
201 first through hole
202 second through hole
301 span width
601 conventional outer shell
602 conventional cooling channel
603 conventional further cooling channel
604 conventional fluid outlet

605 conventional outer fluid outlet
610 conventional inner shell
701 separating element
702 further conventional fluid outlet

The invention claimed is:

1. An airfoil for a gas turbine, the airfoil comprising:

an outer shell comprising an inner volume, an inner shell arranged within the inner volume of the outer shell, wherein the inner shell comprises an inner nose section and an inner tail section, wherein a high pressure side of the inner shell is formed along a first surface section between the inner nose section and the inner tail section, wherein a low pressure side of the inner shell is formed along a second surface section which is located opposite to the first surface section between the inner nose section and the inner tail section, wherein the inner shell is spaced apart from the outer shell such that a first cooling channel is formed along the high pressure side between the inner nose section and the inner tail section, and a second cooling channel is formed along the low pressure side between the inner nose section and the inner tail section, wherein the first cooling channel and the second cooling channel merge into a common cooling channel at the inner tail section, a first tail fin arranged between the first cooling channel and the common cooling channel and defining a first fluid passage configured to control a first mass flow rate of a cooling fluid flowing through the first cooling channel, and a second tail fin arranged between the second cooling channel and the common cooling channel and defining a second fluid passage configured to control a second mass flow rate of a cooling fluid flowing through the second cooling channel, wherein the first fluid passage and the second fluid passage comprise different flow areas, wherein the first tail fin is configured to deform in response to a pressure increase, thereby increasing a flow area of the first fluid passage, and wherein the second tail fin is configured to deform in response to the pressure increase, thereby increasing a flow area of the second fluid passage.

2. The airfoil according to claim 1, wherein the first tail fin comprises at least one first through hole for forming the first fluid passage, and wherein the second tail fin comprises at least one second through hole for forming the second fluid passage.

3. The airfoil according to claim 2, wherein a first size of the at least one first through hole differs to a second size of the at least one second through hole.

4. The airfoil according to claim 1, wherein the high pressure side and the low pressure side are connected within the inner tail section and form an inner tail edge extending along a span width of the inner shell.

5. The airfoil according to claim 1, wherein the first tail fin is secured to the inner tail section and extends as a cantilever toward the high pressure side of the outer shell, wherein the second tail fin is secured to the inner tail section and extends as a cantilever toward the low pressure side of the outer shell, wherein the first fluid passage comprises a first gap formed between a free end of the first tail fin and the high pressure side of the outer shell, and wherein the second fluid passage comprises a second gap formed between a free end of the second tail fin and the low pressure side of the outer shell.

6. The airfoil according to claim 5, wherein the first tail fin is elastically deformable such that the first gap increases with increasing pressure inside the first cooling channel.

7. The airfoil according to claim 6, further comprising a first retaining element arranged within the common cooling channel downstream of the first tail fin, wherein upon reaching a maximum predetermined deformation of the first tail fin the free end of the first tail fin abuts the first retaining element such that further deformation of the first tail fin and associated increase in the first gap is prevented.

8. The airfoil according to claim 5, wherein the second tail fin is elastically deformable such that the second gap increases with increasing pressure inside the second cooling channel.

9. The airfoil according to claim 1, wherein the outer shell comprises an outer nose section, wherein the inner shell is arranged within the inner volume such that the inner nose section and the outer nose section are spaced apart from each other such that a nose volume is generated which is connected to the first cooling channel and the second cooling channel, wherein the inner nose section comprises a fluid outlet such that a cooling fluid is ejectable from the inside of the inner shell into the nose volume.

10. The airfoil according to claim 1, wherein the high pressure side and/or the low pressure side are free of further fluid outlets.

11. A gas turbine, comprising an airfoil according to claim 1 wherein the airfoil forms a stationary vane or a rotatable blade of the gas turbine.

12. The airfoil according to claim 1, wherein the first fluid passage comprises a first flow area, the second fluid passage comprises a second flow area, and the first flow area is less than the second flow area.

13. The airfoil according to claim 8, further comprising:

a second retaining element arranged within the common cooling channel downstream of the second tail fin, wherein upon reaching a maximum predetermined deformation of the second tail fin the free end of the second tail fin abuts the second retaining element such that further deformation of the second tail fin and associated increase in the second gap is prevented.

14. The airfoil according to claim 1, wherein the first tail fin extends as a cantilever across the first cooling channel, wherein the second tail fin extends as a cantilever across the second cooling channel, wherein the first fluid passage comprises a first gap bounded by a free end of the first tail fin, and wherein the second fluid passage comprises a second gap bounded by a free end of the second tail fin.

15. The airfoil according to claim 14, wherein the first tail fin is elastically deformable such that the first gap increases with increasing pressure inside the first cooling channel, and wherein the second tail fin is elastically deformable such that the second gap increases with increasing pressure inside the second cooling channel.

16. A method of manufacturing an airfoil for a gas turbine, the method comprising providing an outer shell comprising an inner volume, arranging an inner shell within the inner volume of the outer shell, wherein the inner shell comprises an inner nose section and an inner tail section, wherein a high pressure side of the inner shell is formed along a first surface section between the inner nose section and the inner tail section, wherein a low pressure side of the inner shell is formed along a second surface section which is located opposite to the first surface section between the inner nose section and the inner tail section, wherein the inner shell is spaced apart from the outer shell such that a first cooling channel is formed along the high pressure side between the inner nose section and the inner tail section, and a second cooling channel is formed along the low pressure side between the inner nose section and the inner tail section, wherein the first cooling channel and the second cooling channel merge into a common cooling channel at the inner tail section, arranging a first tail fin between the first cooling channel and the common cooling channel and defining a first fluid passage configured to control a first mass flow rate of a cooling fluid flowing through the first cooling channel, and arranging a second tail fin between the second cooling channel and the common cooling channel and defining a second fluid passage configured to control, a second mass flow rate of a cooling fluid flowing through the second cooling channel, wherein the first fluid passage and the second fluid passage comprise different flow areas during at least some operating conditions, wherein the first tail fin is configured to deform in response to a pressure increase, thereby increasing a flow area of the first fluid passage, and wherein the second tail fin is configured to deform in response to the pressure increase, thereby increasing a flow area of the second fluid passage.

* * * * *